US005173068A

United States Patent [19]

Dunn et al.

[11] Patent Number: 5,173,068

[45] Date of Patent: Dec. 22, 1992

[54] BODY SURFING APPARATUS

[76] Inventors: Daniel R. Dunn, 3744 Arnold Ave., San Diego, Calif. 92104; James L. Dunn, 315 Vecino Ct., San Diego, Calif. 92177

[21] Appl. No.: 781,492

[22] Filed: Oct. 22, 1991

[51] Int. Cl.[5] ..... B63B 35/85

[52] U.S. Cl. ..... 441/65

[58] Field of Search ..... 441/65, 74, 79, 117, 441/118, 120; 272/1 B; 2/2, 22; 114/357

[56] References Cited

U.S. PATENT DOCUMENTS

| | | | |
|---|---|---|---|
| 1,547,097 | 7/1925 | Curle | 7/192.5 |
| 3,145,400 | 8/1964 | Yoakum | 441/65 |
| 3,162,861 | 12/1964 | Gustafson | 2/2 |
| 3,543,712 | 12/1970 | Vasilatos | 441/65 X |
| 3,755,063 | 8/1973 | Massey et al. | 114/357 X |
| 3,803,652 | 4/1974 | Uyehara | 272/1 B |
| 3,945,041 | 3/1976 | Rhee | 2/2 |
| 4,397,636 | 8/1983 | Ganshaw | 441/65 |
| 4,547,165 | 10/1985 | Scheurer et al. | 441/112 |
| 4,608,717 | 9/1986 | Dunbavand | 2/2.5 |
| 4,689,030 | 8/1987 | McWaters | 441/88 |
| 4,837,859 | 6/1989 | Hamberg | 2/2 |
| 4,866,789 | 9/1989 | Dorm | 2/2 |
| 5,013,271 | 5/1991 | Bartlett | 441/65 |
| 5,015,208 | 5/1991 | Fox et al. | 441/55 |

*Primary Examiner*—Sherman Basinger
*Attorney, Agent, or Firm*—Joseph F. McLellan

[57] ABSTRACT

A body surfing apparatus comprising a body ski having a reduced hydrodynamic drag because it is made of smooth semirigid material for streamlining the upper body, and because it maintains its shape and resists local deformation. Certain edges of the ski are curved and located to minimize drag inducing scooping of water during planing. Side portions of the ski are provided to also reduce such scooping. One embodiment also includes thigh skis to increase the low drag planing area in the lower body region.

12 Claims, 2 Drawing Sheets

FIG. 1
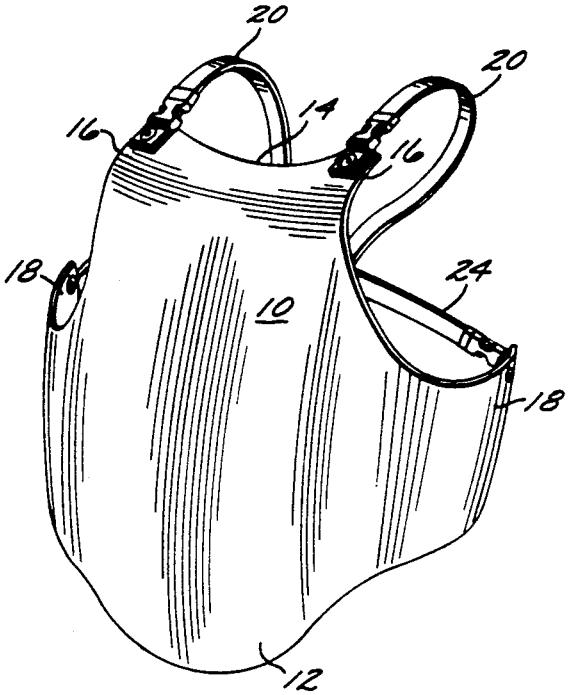
FIG. 2
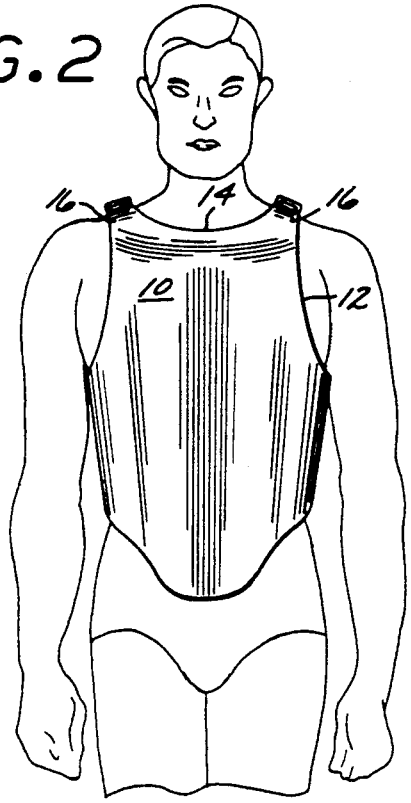
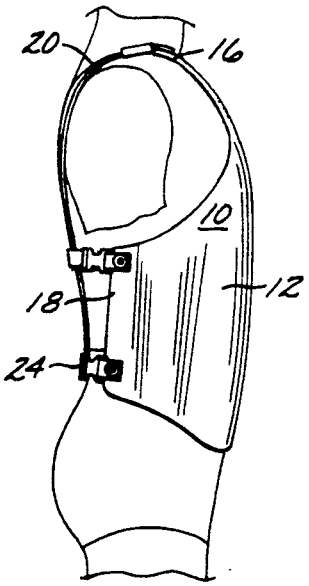
FIG. 3
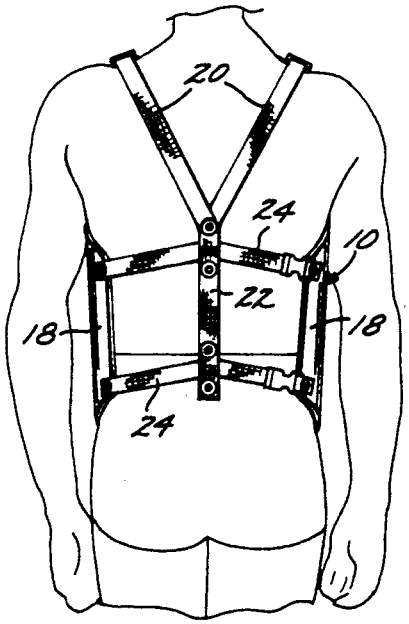
FIG. 4

FIG. 5
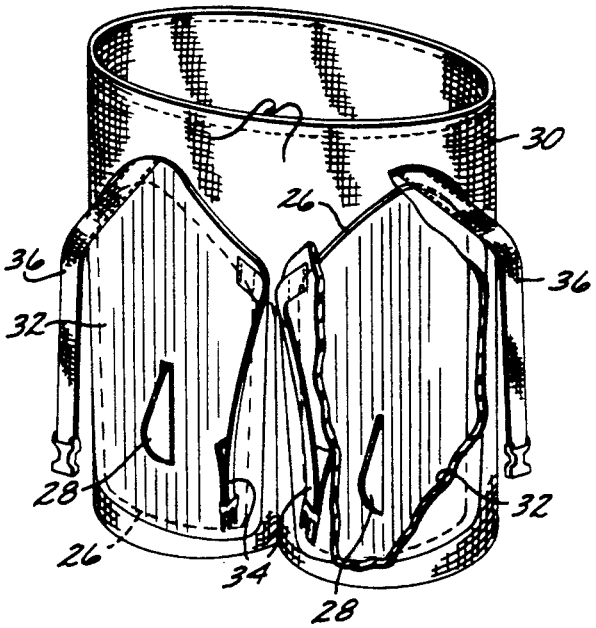
FIG. 6
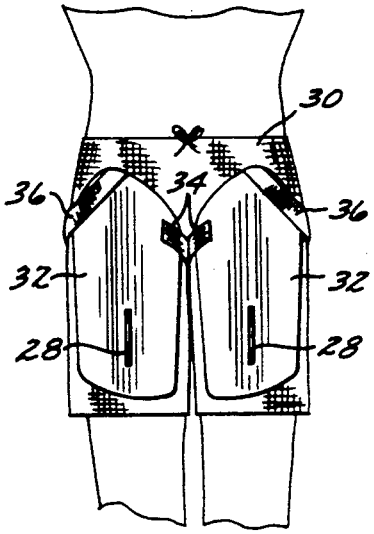
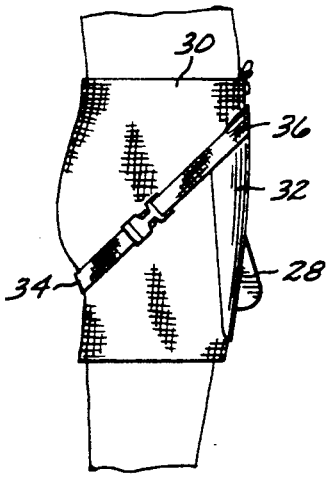
FIG. 7
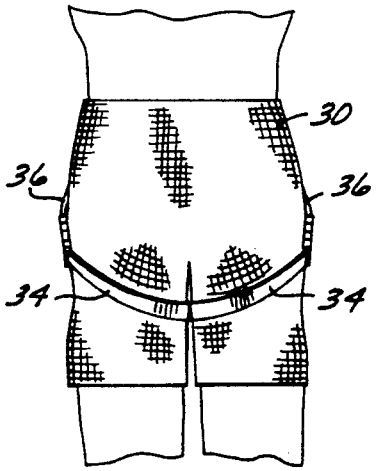
FIG. 8

BODY SURFING APPARATUS

BACKGROUND OF THE INVENTION

1. Field of the Invention

The present invention relates to body surfing apparatus characterized by reduced hydrodynamic drag and improved lateral maneuverability.

2. Description of the Prior Art

Successful body surfing depends upon the ability of a surfer to quickly accelerate onto a breaking wave and maintain that position for a prolonged period of time. Originally the body surfer used no equipment. He or she simply swam out to a likely place, waited for a promising wave, and then swam rapidly to match the speed of the wave. Eventually swim fins came to be used to make this easier.

With experience the surfer learned that he was better able to mount a wave and maneuver across its face if he held his body and particularly his arms and legs in a certain way. If properly done this would minimize hydrodynamic drag and the arms and legs could be extended in a controlled manner to steer the surfer where he wanted to go.

Some have theorized that the position of the head is particularly important in body surfing. U.S. Pat. No. 3,803,652 (Uyehara) discloses a body mounted surfboard having a torso portion which covers the chest and stomach. It includes a "large, soft, neck-encircling" doughnut shaped collar portion to prevent injury to the user. Only this and a narrow waist-encircling band attach the surfboard to the wearer. Otherwise, the surfboard has no sides.

The torso portion tapers from a large section near the chest to a thinner section near the waist, the thicker section accommodating a series of longitudinal grooves in its convex outer surface to provide directional stability and presumably to provide the buoyancy which is a feature of the surfboard.

The buoyant surfboard is extra buoyant at the top of the torso portion and in the region of the large soft collar portion to promote "forcing of the head outward of a wave front when riding a wave" and to keep "the head above the water when the wearer may experience trouble or exhaustion".

U.S. Pat. No. 1,547,097 (Curle) discloses a swimmer's vest which is generally analogous to Uyehara because it is buoyant, but Curle is not concerned with body surfing. His device is in the nature of a vest to be worn under a bathing suit as a safety device. It includes a central body portion having an inflatable pocket on its outer face. A strap arrangement is provided to attach it to the swimmer.

U.S. Pat. No. 4,397,636 (Ganshaw) is informative respecting another buoyant body surfing device. It is a body surfing shirt made of woven material and including a chest pad and a pair of forearm pads made of buoyant material. The shirt protects the user from abrasion and is described as providing extra flotation to "thereby increase the speed and distance traveled during body surfing".

Another buoyant body surfing device is disclosed in U.S. Pat. No. 5,013,271 (Bartlett). It is an air filled or flotation foam filled garment in the nature of a wet suit having a torso portion and short sleeve and leg portions. The object is to increase buoyancy "so that the body surfer can skim across the water powered by only the wave energy". Further buoyancy is provided by including chest and thigh pockets which are inflatable or which receive buoyant foam material. The buoyancy is such that the surfer "merely floats on the back or in an upright position, and remains relaxed while waiting for each wave".

SUMMARY OF THE INVENTION

Body surfing apparatus according to the present invention has reduced hydrodynamic drag because it is made of material having a smooth outer surface which bridges over or streamlines local surface irregularities characterizing the front and sides of the body, while conforming to the body's general contours. Drag is still further reduced because the material is rigid and nonpliable to the extent that it maintains its shape and resists local deformation upon impact with a wave. This is in contrast to those prior art devices which use resilient, soft, deformable or pliant materials.

It is theorized that the forceful impact of a breaking wave locally deforms the skin and flesh of a surfer, and also the surface of any resilient material that is worn. Such deformation appears to adversely affect laminar water flow across such locally deformed areas, increasing hydrodynamic drag and slowing the surfer's speed. This makes it more difficult to achieve the speed necessary to catch a wave and to match its speed once it is caught.

Catching a wave is also easier with the present body surfing apparatus because it is preferably made neutral in buoyancy. In this regard, two common techniques are used to mount a wave. One is to go over and down the face of the wave, and the other is to punch through the wave from behind. If the surfer goes over the top, he must be able to lower his head to increase his speed and quickly reach the wave front position. This would be difficult to do with a buoyant device, and particularly with a buoyant collar that kept his head up.

A soft collar portion would also be locally deformable, which would cause drag and slow the surfer, and its bulk would make it difficult if not impossible to punch or swim through the wave to reach its face.

According to the present invention, the surfer dons a body ski that has a breast portion generally conforming to the shape of the surfer's upper body. The upper edge of the ski in the vicinity of the neck and shoulders is curved slightly rearwardly to prevent the edge from scooping up water and causing drag.

The body ski also includes a pair of side portions which are smoothly faired rearwardly from the breast portion. The upper edges of the side portions are located adjacent the armpit areas of the surfer to prevent water from being scooped in as the surfer planes through the water. They also extend downwardly toward the waist, establishing planing areas which a skilled surfer can utilize to induce changes in body attitude, speed and direction by rolling his body in a controlled manner.

The present apparatus can be mounted to the body of a surfer in any suitable manner, such as by straps or by integration in a garment like a shirt or wet suit.

In a second embodiment of the present apparatus the body ski is used in combination with a pair of thigh skis. These are strapped to the body of the surfer, preferably as part of a garment resembling swimming trunks. Fins extend from the skis to provide directional control.

The thigh skis increase the low drag planing area of the surfer by covering more of his body with smooth, rigid and non-pliable material capable of maintaining its shape and resisting local deformation under wave action.

Other aspects and advantages of the present invention will become apparent from the following more detailed description taken in conjunction with the accompanying drawings.

BRIEF DESCRIPTION OF THE DRAWINGS

FIG. 1 is a perspective view of the body ski of the present body surfing apparatus;

FIG. 2 is a front elevational view of the body ski of FIG. 1 worn by a body surfer;

FIG. 3 is a side elevational view of the arrangement of FIG. 2;

FIG. 4 is a rear elevational view of the arrangement of FIG. 2;

FIG. 5 is a perspective view of the thigh skis of the present body surfing apparatus, illustrated in conjunction with a garment;

FIG. 6 is a front elevational view of the thigh skis and the garment of FIG. 5 worn by a body surfer;

FIG. 7 is a right side elevational view of the arrangement of FIG. 5; and FIG. 8 is a rear elevational view of the arrangement of FIG. 5.

DESCRIPTION OF THE PREFERRED EMBODIMENTS

Referring now to FIGS. 1–4, a body surfing apparatus is illustrated comprising, generally, a body ski 10 made of material having a smooth outer surface for planing over water and which is sufficiently rigid and non-pliable to maintain its shape and resist local deformation from impact with a wave.

Although the body ski could be made of light aluminum plate, resin impregnated glass fiber material, or injection molded plastic material, it is preferably made from a relatively thin sheet of high density thermoplastic polyurethane material. The sheet is first cut to a predetermined pattern, following which it is heated until it can be formed into the contour illustrated. The cooled material is sufficiently bendable that its opposite side edges can be pulled or pried apart when the surfer wants to put it on, but it has an inherent "memory" which thereafter returns it to its original shape, which is maintained while it is being worn.

An important feature of the material is its resistance to local deformation. For example, a depression cannot be formed in it by pressing against it with a finger. It is also characterized by a slippery, smooth surface to minimize hydrodynamic drag, and preferably it is substantially neutral in buoyancy.

The one piece body ski 10 can be made in several sizes to fit different persons, but it has been found that the ski 10 illustrated fits most persons of average stature. Also, rather than the one piece construction, the ski could be made in several sections attached together and slidable relative to each other. This would accommodate persons of different sizes, or the arrangement might be desirable to enable greater freedom of movement.

As will be seen, the body ski 10 is mounted to the user by a system of straps. Various other attachment means could be utilized, if desired, such as attachment devices using the popular "Velcro" type fasteners. Also, the body ski 10 could be made integral with a two way stretch shirt or the like (not shown) to hold it close to the wearer's body and thereby avoid having the edges of the ski develop drag by scooping into the water during planing. Likewise, the body ski 10 could be mounted integral with the front of a wet suit (not shown) if desired. However, whatever the garment with which it is associated, the surface of the ski should be the surface presented to the water.

The body ski 10 includes a front or breast portion 12 which generally overlies and conforms to the contour of the front of the chest or thoracic region of the body. The breast portion 12 includes a scoop neck upper edge 14 which terminates just below the neck of the wearer. This location provides sufficient clearance to avoid bumping of the ski into the wearer's neck during use.

The upper edge 14 is also slightly curved rearwardly, particularly at the upper edge sides 16, so that during planing the upper edge 14 does not develop drag by scooping into the water.

The body ski 10 further includes a pair of side portions 18 which form rearward continuations or extensions of the breast portion on either side, the side portions fairing smoothly rearwardly around the sides of the wearer as illustrated. If desired, the side portions 18 could be continued around the back of the wearer and touch or overlap, but the arrangement shown is preferred.

The side portions 18 are dimensioned to overlie the thoracic region between the armpit and midsection areas. The proximity of the upper edges of the side portions 18 to the location of the wearer's armpits reduces the susceptibility to scooping of water inside the side portions during planing. If the height or expanse of the side portions 18 were reduced or narrowed in this area, the straps or other mounting means would have to be perhaps uncomfortably tight to insure that the side portions 18 were sufficiently snug against the body to prevent scooping of water inside them.

The mounting means for attaching the body ski 10 to the body in snug, close fitting relation against the body comprise a pair shoulder or of upper straps 20 each detachably attached at one end to one of the upper edge sides 14. The opposite extremities extend over the wearer's shoulder and down his back in overlapping relation. The overlapping portions are secured together by vertically spaced apart fasteners to define an anchor strap 22.

The mounting means also includes a pair of side or horizontal straps 24 which extend between the overlapped portions of the anchor strap 22. The free ends of the straps 24 are detachably secured, respectively, to the upper and lower corners of the side portions 18.

The detachable connection of the straps 20 and 24 is provided by fasteners which are each characterized by receptacle and bayonet portions. Such fasteners are readily available on the market. In use, the bayonet portion is biased to snap into locked position within the receptacle portion, and it is easily removed by squeezing and withdrawing it.

Referring now to FIGS. 5–8, the present body surfing apparatus may also include a pair of thigh skis 26. The skis 26 are preferably made of the same material as the body ski 10 to obtain the characteristics and functions described for the ski 10.

Each thigh ski 26 is configured to generally conform to the shape of the front of the thigh of the wearer. Each ski 26 preferably includes a forwardly or outwardly projecting fin 28 to provide directional stability during planing of the skis 26 over the water.

Although many attachment means for mounting the skis 26 to a wearer will suggest themselves to those skilled in the art, the illustrated attachment means comprise a snug fitting garment 30 in the nature of a pair of swimming trunks made of elastic stretch material or the like. The garment clings to the body and reduces susceptibility to scooping of water behind the skis 26 during planing.

The thigh areas of the garment 30 include pockets which are defined in the back by the garment material, and in the front by a pair of covers 32 made of thin plastic material characterized by a very slick or smooth surface. The covers 32 are relatively thin and flexible, but the elastic material of the garment 30 stretches them into snug engagement with the skis 26 which they overlie. Consequently, the semirigid material of the skis 26 prevents any local deformation of the plastic covers 32 by wave action. The fins 28 project through suitable slits in the plastic covers 32. The size and location of the skis 26 are made so that they extend generally from below the midsection of the body to the thighs.

A pair of inner straps 34 are sewn at their front ends to the inner side edges of the plastic covers 32, and are adapted to extend through the crotch area of the wearer and around the upper portions of the legs, terminating at the wearer's sides.

A pair of upper straps 36 are sewn at their front ends to the upper side edges of the plastic covers 32. The straps 36 are arranged to extend outwardly and downwardly to positions at the wearer's sides adjacent the ends of the straps 34. The adjacent ends of the straps 34 and 36 are adapted to be detachably connected together by fasteners like those described in connection with the straps of the body ski 10.

A variety of other connection means may be employed to mount the thigh skis 26 in position, the important requirement being that they be held snugly against the wearer's body adjacent their edges to prevent water scooping, and that the skis 26 serve as an extension of the planing area provided by the body ski 10. The skis 26 eliminate the local deformation and drag which would otherwise be present if the wearer's body, or fabric or other high drag apparel, were exposed to the wave action.

From the foregoing it will be apparent that the present body surfing apparatus reduces hydrodynamic drag, which facilitates catching a wave and matching its speed, and also provides greater lateral maneuverability, in that a body surfer can also roll and plane on his sides.

Various modifications and changes may be made with regard to the foregoing detailed description without departing from the spirit of the invention.

What is claimed is:

1. Body surfing apparatus comprising:

a body ski made of material having a smooth outer surface for planing over water and which is sufficiently rigid and non-pliable to maintain its shape and resist local deformation from impact with a wave, the body ski including a breast portion generally overlying and conforming to the contour of the front of the thoracic region of the body, and further including a pair of side portions smoothly faired rearwardly from the breast portion, the side portions being dimensioned to overlie the sides of the thoracic region between the areas of the armpit and the midsection to reduce susceptibility to scooping of water behind the side portions during planing;

mounting means attached to the body ski and adapted to be disposed about a person's body to maintain the body ski in position;

a pair of thigh skis, each of the thigh skis having a smooth outer surface for planing over water ad being made of a material which is sufficiently rigid and non-pliable to maintain the shape of the thigh ski and resist local deformation from impact with a wave, each of the thigh skis generally conforming to the shape of the adjacent thigh region of the body;

a pair of fins mounted to and projecting from the thigh skis, respectively, to provide directional stability during planing; and attachment means attached to the pair of thigh skis and adapted to be disposed about a person's body to maintain the thigh skis in position.

2. Body surfing apparatus according to claim 1 wherein the attachment means comprises a plurality of straps attached to and extending from the thigh skis, and adapted to be attached together behind the body.

3. Body surfing apparatus according to claim 1 wherein the attachment means comprises a garment mounting the pair of thigh skis and made of elastic material adapted to cling to the body to reduce susceptibility to scooping of water behind the thigh skis during planing.

4. Body surfing apparatus according to claim 3 wherein the garment includes a pair of pockets receiving, respectively, the pair of thigh skis, the pockets having smooth outer surfaces, and the pair of fins projecting outwardly through the pockets, respectively.

5. Body surfing apparatus according to claim 3 wherein the thigh skis are dimensioned to extend from below the midsection of the body to the thighs.

6. Body surfing apparatus adapted to be worn by a surfer and comprising:

a body ski made of non-buoyant sheet material having a smooth outer surface for planing on water, and further having sufficient rigidity and non-pliability to resist local deformation by wave action, the body ski including a breast portion configured to generally overlie and conform to the front of the surfer's body between the neck and waist, the breast portion having neck and shoulder upper edge portions configured to generally overlie the surfer's body adjacent the neck and shoulders, respectively, the shoulder upper edge portions being rearwardly curved to generally overlie and conform to the upper forward regions of the surfer's shoulders, the body ski further including a pair of side portions rearwardly curved and extending from the breast portion to generally overlie and conform to the sides, respectively, of the surfer's body between the armpit and waist regions of the body; and mounting means for disposition about the surfer's body, and including shoulder straps attached to the shoulder upper edge portions, and side straps attached to the side portions, the mounting means being operative to urge the shoulder and neck upper edge portions and the side portions snugly against the surfer's body to reduce scooping of water by the shoulder and neck upper edge portions and the side portions when the surfer mounts and planes on a wave.

7. Body surfing apparatus according to claim 6 wherein the neck upper edge portion is rearwardly curved.

8. Body surfing apparatus according to claim 6 wherein the mounting means includes additional straps for attachment to the shoulder straps and to the side straps behind the surfer's body for urging the shoulder and neck upper edge portions and side portions snugly against the surfer's body.

9. Body surfing apparatus according to claim 6 wherein the body ski is made of plastic material.

10. Body surfing apparatus according to claim 9 wherein the plastic material is high density polyurethane.

11. Body surfing apparatus according to claim 9 wherein the plastic material is thermoplastic.

12. Body surfing apparatus adapted to be worn by a surfer and comprising:

a body ski made of sheet material having a smooth outer surface for planing on water, and sufficiently nonbuoyant that, when worn by a surfer, the surfer's body is not buoyed to the water surface, the sheet material further having sufficient rigidity and non-pliability to resist local deformation by wave action, the body ski including a breast portion configured to generally overlie the front of the surfer's body between the neck and waist, the breast portion having neck and shoulder upper edge portions configured to generally overlie and conform to the surfer's body adjacent the neck and shoulders, the body ski further including a pair of side portions extending rearwardly from the breast portion and curved to generally overlie and conform to the sides, respectively, of the surfer's body between the armpit and waist regions of the body; and mounting means for disposition about the surfer's body, and including attachment means secured to the shoulder upper edge portions and to the side portions and configured to extend over and against the shoulders and sides of the surfer's body, and operative to urge the shoulder and neck upper edge portions and side portions snugly against the surfer's body to reduce scooping of water by the shoulder and neck upper edge portions and the side portions when the surfer mounts and planes on a wave.

* * * * *